US007205027B2

(12) United States Patent
Brosemer

(10) Patent No.: US 7,205,027 B2
(45) Date of Patent: Apr. 17, 2007

(54) POWDER COATING METHOD PROVIDING ENHANCED FINISH CHARACTERISTICS

(76) Inventor: Brandyn Brosemer, 138 S. Telegraph Hill Rd., Holmdel, NJ (US) 07733

( * ) Notice: Subject to any disclaimer, the term of this patent is extended or adjusted under 35 U.S.C. 154(b) by 103 days.

(21) Appl. No.: 10/950,925

(22) Filed: Sep. 27, 2004

(65) Prior Publication Data

US 2006/0068089 A1 Mar. 30, 2006

(51) Int. Cl.
*B05D 3/12* (2006.01)
*B05D 3/02* (2006.01)

(52) U.S. Cl. ..... 427/346; 427/180; 427/185; 427/475; 427/374.1

(58) Field of Classification Search ..... 427/346, 427/180, 185, 475, 374.1
See application file for complete search history.

(56) References Cited

U.S. PATENT DOCUMENTS 3,815,535 A * 6/1974 Becker et al. ..... 72/267
3,962,990 A * 6/1976 Phipps et al. ..... 118/620
5,068,123 A * 11/1991 Goto et al. ..... 427/474
5,123,373 A * 6/1992 Iyer et al. ..... 118/612
5,167,989 A * 12/1992 Dudek et al. ..... 427/202
5,470,603 A * 11/1995 Staniforth et al. ..... 427/2.14
6,284,311 B1 * 9/2001 Gregorovich et al. ..... 427/185
2003/0044524 A1 * 3/2003 Hoffland ..... 427/180

* cited by examiner

*Primary Examiner*—Fred J. Parker
(74) *Attorney, Agent, or Firm*—Jeffery J. Brosemer

(57) ABSTRACT

A powder coating method that provides enhanced finish characteristics to a powder coated object. The object to be powder coated is vibrated such that the powder readily flows on the surface of the object. The improved flow of the applied powder results in a powder coated object having enhanced, or otherwise superior finish characteristics. The method works with existing powder coating methods, systems, and materials and the vibration may be applied before, during, and/or after the powder is applied, i.e., during heating and/or curing. Additionally, the vibrations may be produced by a variety of means and/or methods including direct mechanical contact (i.e., a vibrating plate), indirect mechanical contact (i.e., a vibrating hang wire), and/or indirect non-contact (i.e., acoustic) methods.

8 Claims, 2 Drawing Sheets

200

POWDER COATING METHOD PROVIDING ENHANCED FINISH CHARACTERISTICS

FIELD OF THE INVENTION

This invention relates generally to the field protective film coatings and in particular relates to a powder coating method that produces improved finish characteristics.

BACKGROUND OF THE INVENTION

Powder coating is a process of coating a surface of an object in which a powdered material is applied to the object using electrostatic or compressed air method(s). The object, including the applied powdered material is heated (cured) to the melting point of the powdered material during which it (the powdered material) generally flows to form a smooth film which subsequently dries (cools) to a firm, durable finish exhibiting strong resistance to scratches, cracking, peeling, UV rays, certain chemicals, and rust.

Very generally, the entire powder coating process involves several steps namely: 1) blasting, stripping and/or solvent cleaning an object to remove oils, dirt, rust, etc.; 2) pre-treating the object by exposing it to pre-treatment or conversion chemicals such as phosphate or zinc-based, to further protect it and improve powder adhesion; 3) cleaning and drying the object; 4) applying the powder coat powder to the object, usually with an electrostatic gun or fluidized bed; and 5) curing the applied powder in an oven.

Although finish represents only one attribute of a coated object, it is the most visible and a particularly influential characteristic. Advantageously, powder coatings may have a positive impact on a consumer, both directly and indirectly.

More specifically, powder coatings generally provide superior consistency and uniformity of finish without sags, drips, runs or bubbles. They provide extremely tough, durable films, enhancing high quality products. In general, the performance properties such as impact resistance, flexibility and corrosion resistance of powder coatings are better than those experienced with liquid paints. Powder coated objects resist cracking, peeling and marring during handling and normal use.

In addition, powder coatings are frequently used as a cost saving alternative to liquid paints with respect to energy savings, labor costs, rework costs, material usage, waste disposal and overall efficiency. The advantage to manufactures and consumers is a coated object having a superior quality finish at reasonable cost.

Lastly, environmental issues are of significant interest and importance. Unlike many liquid paints, powder coatings are compliant with environmental regulations. More particularly, liquid paints have traditionally contained solvents that may contribute to air pollution and, in some cases, ozone depletion. Advantageously, powder coatings are free of such pollutants, and properly formulated powder coatings generate no such hazardous waste.

Powders used in powder coating applications generally comprise resins, pigments and additives—while advantageously containing no solvents. And while powder coating powders are available in a wide range of colors and exhibit a broad range of chemical properties, there are two basic types of powders that are widely used in powder coating namely, organic thermoset powders and organic thermoplastic powders.

Organic thermoset powders melt, flow and chemically crosslink within themselves when heated (cured) during a powder coating process to produce a heat stable material that will typically not soften when further exposed to normal heat conditions. In contrast, organic thermoplastic powders do not chemically crosslink when heated (cured) during a powder coating process and thus may be remelted by applying heat. Regardless of the specific type of powder used, there are generally two primary methods of application, namely electrostatic spray and fluidized bed.

In an electrostatic spray process, spray guns are used to apply the powder to an object to be powder coated. Since the powder is electrostatically charged, it will electrostatically adhere to the object.

In a fluidized bed process, dry air is forced through a porous membrane into an open top tank which is about half filled with powder. The air suspends the powder, making it act like a fluid. The object to be coated is preheated above a fusion point of the powder, and then dipped in the fluidized powder, which adheres to the object. An electrostatic fluidized bed is similar to the fluidized bed, except that a high voltage is applied to the powder. When a grounded object is placed into the electrostatic fluidized bed, the powder electrostatically adheres to the object.

Given its commercial importance, methods and/or techniques that improve the finish characteristics of a powder coated object would represent a significant advance in the art. Such a method is the subject of the present invention.

SUMMARY OF THE INVENTION

I have developed a powder coating method that provides enhanced finish characteristics to a powder-coated object. In particular, my method involves vibrating the object to be powder coated such that the powder flows more readily on the surface of the object. The improved flow of the applied powder results in a powder coated object having enhanced, or otherwise superior finish characteristics. Advantageously, my inventive method works with existing powder coating methods, systems, and materials.

According to the invention, the part to be powder coated is vibrated such that the applied powder flows upon the surface of the object. The vibration may be applied before, during, and/or after the powder is applied, i.e., during heating and/or curing. Additionally, the vibrations may be produced by a variety of means including direct mechanical contact (i.e., a vibrating plate), indirect mechanical contact (i.e., a vibrating hang wire), and/or indirect non-contact (i.e., acoustic) methods.

Further features and advantages will become apparent with reference to the accompanying drawing and illustrative detailed description.

DETAILED DESCRIPTION

Figure 1:
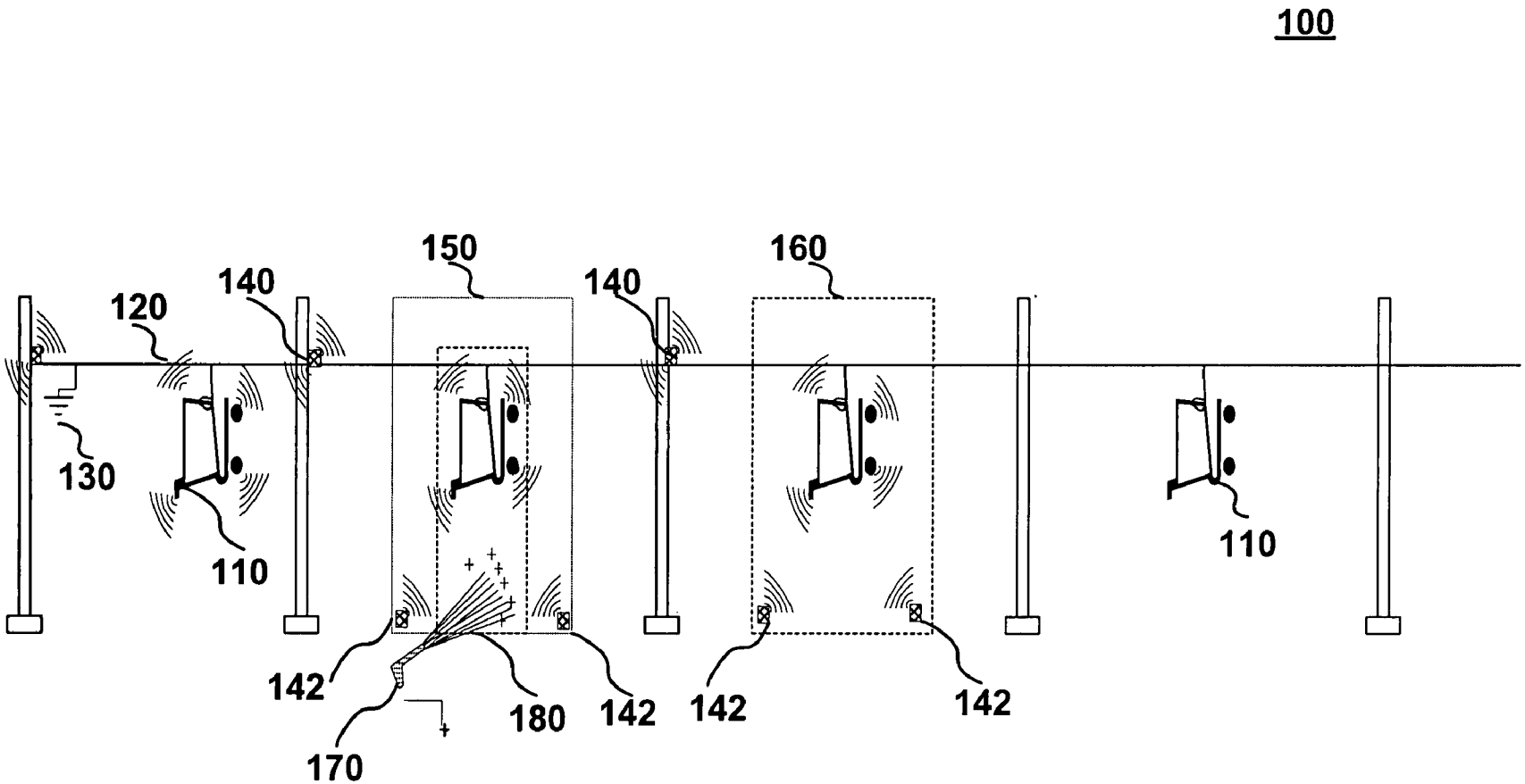
FIG. 1 is block diagram depicting an illustrative powder coating process according to the present invention.

Illustrative examples of our invention will now be presented with reference to the attached drawing. Referring to FIG. 1, there is shown a block diagram that depicts a powder coating process according to my inventive method. Specifically, object 110 is suspended from an overhead hang wire or conveyor 120 which may be electrically grounded 130. The overhead conveyor 120 transports the object 110 through powder coat room 150 where a powder coating is applied, through a heating/curing oven 160 in which the applied powder coating is melted/cured onto the surface(s) of the object 110, and then subsequently removed where it may cool, as necessary.

As can be readily appreciated by those skilled in the art, the powder coating may be applied in the powder coat room 150 through the action of an electrostatic spray gun 170, which sprays charged powder 180 onto the object being powder coated. Since the object carries an electrostatic charge opposite the electrostatic charge carried by the sprayed powder 180, the charged powder adheres electrostatically to the object for subsequent melting/curing in oven 160.

It should be noted at this point that while I have used the electrostatic spray method for powder application as an example, It is understood that powder may be applied by other methods such as fluidized bed or an electrostatic fluidized bed. Additionally, the simplified block diagram FIG. 1, does not show commonly used and readily understood pre-treatment and/or post-treatment systems or methods. As will become apparent, my inventive method advantageously works with all such systems and methods.

Returning now to FIG. 1, conveyor vibrators 140 serve to vibrate the overhead conveyor 120 and therefore object 110. Consequently, when the charged powder coat 180 is applied, the vibrating object 110 results in improved "flow" of the powder on the surface of the object 110.

In addition, the vibrating overhead conveyor 120 may continue to cause the object 110 to vibrate during powder coat melting/curing in oven 160 or thereafter. Such a procedure may be particularly advantageous in situations where certain specific finish characteristics are desired. For example, very rapid vibrations during the cooling of a powder-coated part may produce a desirable "texture" to the powder coat finish.

Of particular interest, object vibrations may be induced through non-contact, i.e., sonic mechanisms such as sonic vibrators 142 shown in FIG. 1. In a simple configuration, sonic vibrators 142 are broad range loudspeaker(s) that induce the desirable vibrations in an object to be powder coated. And while I have referred to them as "sonic" vibrators for my purpose(s) here, the reader should not restrict the practice of my invention to sonic ranges. Indeed, ultrasonic ranges, i.e., >20 KHz may prove particularly useful for certain application. For most purposes however, vibrations in the range of 20–200 KHz (20–200,000 Hz) should prove satisfactory for most applications.

Of course, my invention is not limited to a single source of vibration. Advantageously, an object to be powder coated may be vibrated through the action of a combination of sources, i.e., non-contact vibrating overhead wire and/or sonic vibrators such as those shown in FIG. 1. In addition, contact sources of vibration (i.e., vibrating plates—not shown) may be used when effective such as with relatively heavy objects to be powder coated. In such an instance, the object to be powder coated is placed in contact with a vibrating plate (not shown in FIG. 1), to effect the flow of the powder according to my invention. Accordingly, my invention may be employed through both contact and non-contact means, or a combination thereof.

Figure 2:
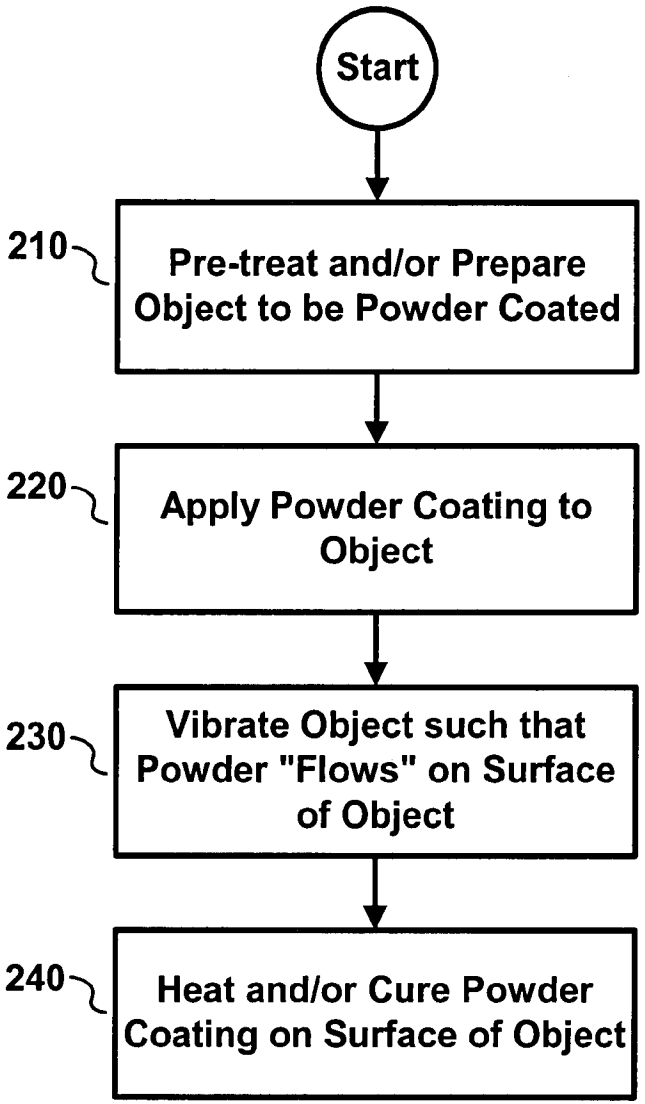
FIG. 2 is a flow chart depicting the method of the present invention.

Turning now to FIG. 2, there is shown a flow chart 200 that depicts the steps associated with my powder coating method. Specifically, an object to be powder coated is pre-treated and/or prepared in step 210. Such pre-treatments and/or preparations are well known and include simple washing/drying as well as chemical cleaning or treatment with compositions containing phosphates and/or Zinc. These treatments and/or preparations generally ready the surface of the object to be powder coated so that it more readily and permanently receives the powder coating.

At step 220, the powder is applied to the object by any of a number of known methods including electrostatic spray and/or fluidized bed and/or electrostatic fluidized bed. The object is sufficiently vibrated at step 230 such that the applied powder flows on the surface of the object. Finally, at step 240, the object is heated and/or cured in such a manner that the powder melts and/or crosslinks or otherwise becomes permanently adhered to the surface of the object. And while my flowchart shows the vibrating step 230 being subsequent to the application step 220, and prior to the heating/curing step 240, it is understood that the vibrations may be introduced during and/or after the application of the powder and subsequent heating/curing, as long as the object is vibrated sufficiently while powder is on the surface of the object.

Of course, it will be understood by those skilled in the art that the foregoing is merely illustrative of the principles of this invention, and that various modifications can be made by those skilled in the art without departing from the scope and spirit of the invention. In particular, it is not limited to particular types of powders or vibrating devices. As long as the vibrations effect the flow of the powder on the surface of the object to be powder coated, my invention is applicable. Accordingly, my invention is to be limited only by the scope of the claims attached hereto.

What is claimed is:

1. A powder coating method providing enhanced finish characteristics comprising the steps of:

applying coating powder to the surface of an object;

vibrating the object sufficiently to promote the flow of the applied powder on the surface of the object; and heating/curing the powder on the surface of the object;

THE METHOD CHARACTERIZED IN THAT the object is vibrated during the heating/curing step or subsequent thereto while cooling such that a textured finish is produced.

2. The method according to claim 1 wherein the coating powder is applied with an electrostatic spray system.

3. The method according to claim 1 wherein the coating powder is applied in a fluidized bed.

4. The method according to claim 1 wherein the coating powder is applied in an electrostatic fluidized bed.

5. A powder coating method providing enhanced finish characteristics comprising the steps of:

applying coating powder to the surface of an object;

vibrating the object such that the flow of the powder on the surface of the object is facilitated; and heating/curing the applied powder on the surface of the object wherein the object is vibrated during the heating/curing step or subsequent thereto while cooling such that a textured finished is produced.

6. The method according to claim 5 wherein the coating powder is applied with an electrostatic spray system.

7. The method according to claim 5 wherein the coating powder is applied in a fluidized bed.

8. The method according to claim 5 wherein the coating powder is applied in an electrostatic fluidized bed.

* * * * *